US007614434B2

(12) United States Patent
DeMichele

(10) Patent No.: US 7,614,434 B2
(45) Date of Patent: Nov. 10, 2009

(54) WEARABLE DISPLAY WALLET AND METHOD OF USE THEREOF

(76) Inventor: Cynthia DeMichele, 737 Feura Bush Rd., Delmar, NY (US) 12054

( * ) Notice: Subject to any disclaimer, the term of this patent is extended or adjusted under 35 U.S.C. 154(b) by 595 days.

(21) Appl. No.: 10/865,395

(22) Filed: Jun. 10, 2004

(65) Prior Publication Data

US 2004/0250933 A1 Dec. 16, 2004

Related U.S. Application Data

(60) Provisional application No. 60/478,509, filed on Jun. 13, 2003.

(51) Int. Cl.
*A45F 3/14* (2006.01)

(52) U.S. Cl. ..... 150/145; 224/218; 224/219

(58) Field of Classification Search ..... 224/222, 224/219, 183, 218, 220, 267, 350, 376, 378; 150/145

See application file for complete search history.

(56) References Cited

U.S. PATENT DOCUMENTS

| | | | | | |
|---|---|---|---|---|---|
| 753,457 | A | * | 3/1904 | Weissbrod | 248/444 |
| 1,582,492 | A | | 4/1926 | Tantlinger | |
| 2,477,840 | A | | 8/1949 | Vasilas | |
| 2,544,618 | A | | 3/1951 | Smith | |
| 3,214,852 | A | * | 11/1965 | Ford et al. | 40/640 |
| 3,660,915 | A | | 5/1972 | Davis | |
| 4,332,338 | A | * | 6/1982 | Christiansen | 224/222 |
| 4,570,688 | A | | 2/1986 | Williams | |
| 4,705,086 | A | | 11/1987 | O'Neill | |
| 4,744,497 | A | | 5/1988 | O'Neal | |
| 4,746,043 | A | * | 5/1988 | Booker | 224/219 |
| 4,763,821 | A | * | 8/1988 | Powell | 224/267 |
| 4,890,728 | A | | 1/1990 | Grimsley | |
| 4,905,881 | A | | 3/1990 | Graber | |
| 4,937,963 | A | | 7/1990 | Barnes | |
| 4,942,913 | A | | 7/1990 | Musso | |
| 4,958,855 | A | | 9/1990 | Shipp | |
| 5,059,052 | A | | 10/1991 | Casper | |
| 5,215,237 | A | | 6/1993 | Wu | |
| 5,341,972 | A | | 8/1994 | Jacks | |
| D352,824 | S | * | 11/1994 | Saggese, Jr. | D3/226 |
| 5,400,936 | A | | 3/1995 | Jones et al. | |
| 5,431,207 | A | | 7/1995 | Siegel | |
| D371,675 | S | | 7/1996 | Carter | |
| 5,535,797 | A | | 7/1996 | Martindale | |
| D373,900 | S | * | 9/1996 | Montgomery, Sr. | D3/226 |
| 5,588,571 | A | | 12/1996 | Mazzo | |
| 5,671,481 | A | | 9/1997 | Giard | |
| 5,747,928 | A | * | 5/1998 | Shanks et al. | 313/498 |
| 5,755,366 | A | | 5/1998 | Mazzo | |
| 5,924,136 | A | | 7/1999 | Ogean | |

(Continued)

*Primary Examiner*—Tri M Mai
(74) *Attorney, Agent, or Firm*—Schmeiser, Olsen & Watts

(57) ABSTRACT

The invention relates generally to wallets, and more particularly to wallets useful for organizing, carrying, and displaying essential items. The wallet disclosed herein is a wearable display wallet that includes a fastening device for releasably retaining the wallet in a closed configuration and a display configuration. The closed configuration is a reverse embodiment of the display configuration. When the wallet is carried in the closed configuration, a display compartment is on an interior of the wallet. When said wallet is carried in the display configuration, the display compartment is on an exterior of the wallet. The fastening device is able to secure the wallet in both the closed configuration and the display configuration.

17 Claims, 4 Drawing Sheets

U.S. PATENT DOCUMENTS

| | | | | |
|---|---|---|---|---|
| 6,029,724 | A | 2/2000 | Rudnick | |
| 6,085,449 | A * | 7/2000 | Tsui | 40/1.6 |
| 6,112,961 | A | 9/2000 | Phillips | |
| 6,170,087 | B1 | 1/2001 | Brannon | |
| 6,227,424 | B1 * | 5/2001 | Roegner | 224/219 |
| 6,328,193 | B1 | 12/2001 | Schiff | |
| 6,330,961 | B1 * | 12/2001 | Borja | 224/222 |
| D459,875 | S | 7/2002 | Mack et al. | |
| D460,257 | S | 7/2002 | Williams et al. | |
| 6,418,563 | B1 | 7/2002 | Turner | |
| 6,443,341 | B1 | 9/2002 | Rittmann | |
| D487,844 | S * | 3/2004 | Nichols | D3/215 |
| 6,752,305 | B2 * | 6/2004 | Shattuck | 224/603 |
| D507,103 | S * | 7/2005 | Charles, Jr. | D3/215 |
| D520,565 | S * | 5/2006 | Gonzales | D19/89 |
| 2001/0035443 | A1 * | 11/2001 | Jones et al. | 224/222 |
| 2001/0054245 | A1 * | 12/2001 | Williams | 40/661 |
| 2002/0162355 | A1 | 11/2002 | Andersen | |

* cited by examiner

WEARABLE DISPLAY WALLET AND METHOD OF USE THEREOF

RELATED APPLICATION

The present invention claims priority to U.S. Provisional Application No. 60/478,509 filed Jun. 13, 2003, which is incorporated herein by reference in its entirety.

BACKGROUND OF THE INVENTION

1. Technical Field

The invention relates generally to wallets and wallet designs, and more particularly to wallets worn on a person as outerwear having capabilities of organizing, carrying, and displaying essential items.

2. Related Art

In the field of wallets and wallet design, wallets are typically designed to be carried in a pocket, purse, bag, and etc. Wallets of the aforementioned type are not designed to allow conversion into a wallet for display purposes and for wearing on a user's outer garment or physical extremities. Current wallets and wallet designs for such a conversion often cannot secure varying contents within, allow for displaying the contents, and provide for ready access to the contents by the user or a second party. Current devices and designs also cannot undergo a conversion into a wallet for display purposes and for wearing on a user's outer garment or physical extremities without the addition, removal, or manipulation of extraneous attachment devices.

Thus, there exists a need for a wallet device and method thereof which overcomes the aforementioned, and other, deficiencies in the art of wallets and wallet designs.

SUMMARY OF THE INVENTION

In a first general aspect of the present invention is provided a wearable display wallet comprising: a fastening device on a first panel of the wallet for releasably retaining the wallet in at least one of a closed configuration and a display configuration, wherein the closed configuration is a reversed embodiment of the display configuration, wherein the wallet is carried in the closed configuration and includes a display compartment on an interior of the wallet, and wherein, when said wallet is carried in the display configuration, the display configuration includes the display compartment on an exterior of the wallet, and the fastening device secures the wallet in the display configuration.

In a second general aspect of the present invention is provided a method of wearing a display wallet comprising: providing a wearable display wallet having a fastening device on a first panel of the wallet for releasably retaining the wallet in at least one of a closed configuration and a display configuration, wherein the closed configuration is a reversed embodiment of the display configuration, wherein the wallet is carried in the closed configuration, the closed configuration includes a display compartment on an interior of the wallet, and the fastening device secures the wallet in the closed configuration, and wherein, when said wallet is carried in the display configuration, the display configuration includes the display compartment on an exterior of the wallet, and the fastening device secures the wallet in the display configuration; releasably attaching the wallet to an extremity of a body, a garment, or an accessory in a display configuration, wherein the display configuration includes the display compartment on the exterior of the wallet; detaching the wallet from an extremity of the body, the garment, or the accessory in a display configuration; and relesably attaching the wallet to the extremity of the body, the garment, or the accessory in a closed configuration, wherein the closed configuration includes the display compartment on the interior of the wallet.

The foregoing and other features and advantages of the invention will be apparent from the following more particular description of embodiments of the invention.

BRIEF DESCRIPTION OF THE DRAWINGS

The features of the present invention will best be understood from a detailed description of the invention and an embodiment thereof selected for the purposes of illustration and shown in the accompanying drawings in which.

DETAILED DESCRIPTION OF THE INVENTION

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of the embodiment.

The present invention provides a wearable display wallet and a method of use thereof. While the wearable display wallet is able to perform many functions, it will be referred to herein as a wallet.

Essential documents are credentials that a carrier of the credentials deems necessary to have on their being and cannot afford to lose. Essential documents include but are not limited to identification papers such as passports, driver's licenses, birth certificates, identification cards, and copies thereof; and travel documents such as airline tickets, bus tickets, train tickets, maps, itineraries, boarding passes, medical information cards, insurance documentation, and copies thereof.

Essential items are objects that a carrier of the objects deems necessary to have on their being and cannot afford to lose. Essential items include but are not limited to currency such as bills, coins, and the like; checks such as personal checks, bank checks, traveler's checks, and the like; cards such as debit cards, credit cards, smart cards, loyalty cards, phone cards, and the like; and other such as car keys, house keys, apartment keys, hotel keys, jewelry, medication, and the like; and combinations thereof.

Figure 1:
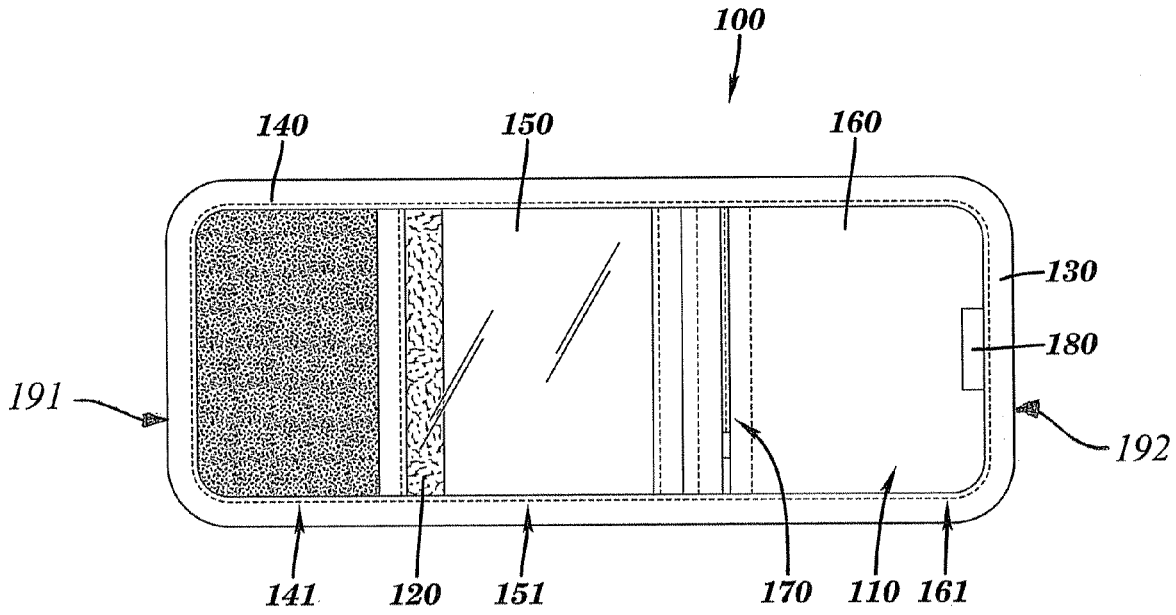
FIG. 1 depicts a plan view of a first side of a wearable display wallet in accordance with the present invention.

FIG. 1 depicts a plan view of a first side or surface of a wallet 100 for wearing on a person as outerwear, in accordance with the present invention. The first side or surface extends from a first edge 191 of the wallet 100 to a second edge 192 of the wallet 100. An embodiment of the present invention is the wallet 100 comprising: a first panel or portion 141, a third panel or portion 151, and a second panel or portion 161. The panels 141, 151, and 161 are made of pliable or non-pliable materials; stretchable or non-stretchable material; natural materials such as leather, cloth, fabric; and man-made materials such as nylon, vinyl, synthetic mesh, velvet, satin, sateen, neoprene, and polyester; and combinations thereof. The panels 141, 151, and 161 are generally rectangular in shape but may also include generally square shapes as well as combinations thereof.

Figure 2:
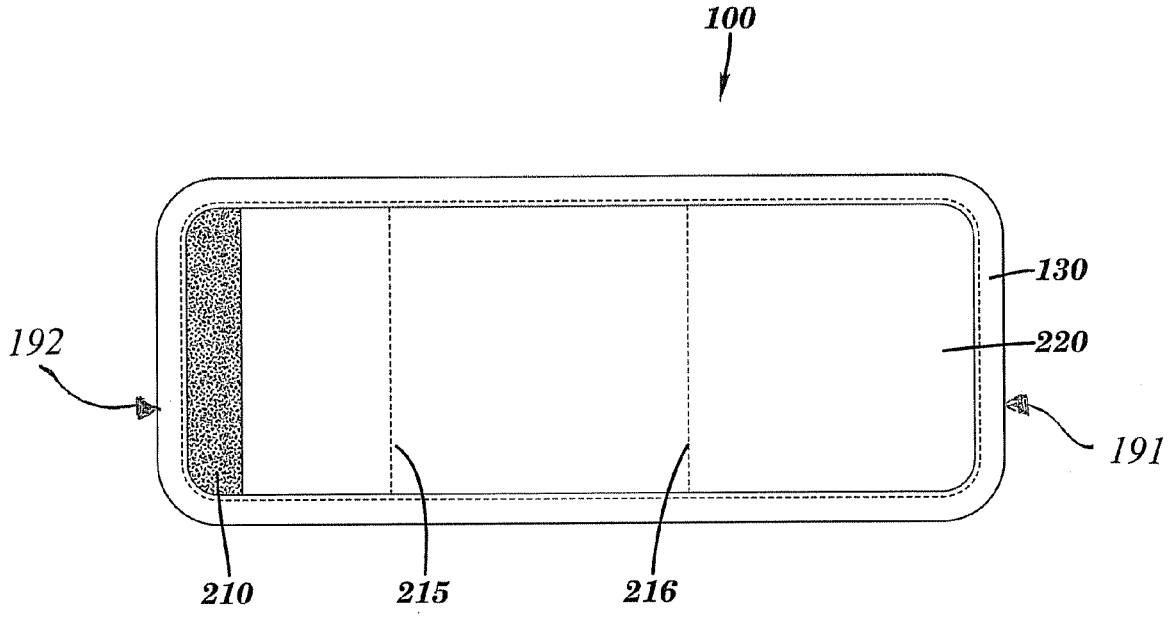
FIG. 2 depicts a plan view of a second side of a wearable display wallet in accordance with the present invention.
Figure 4:
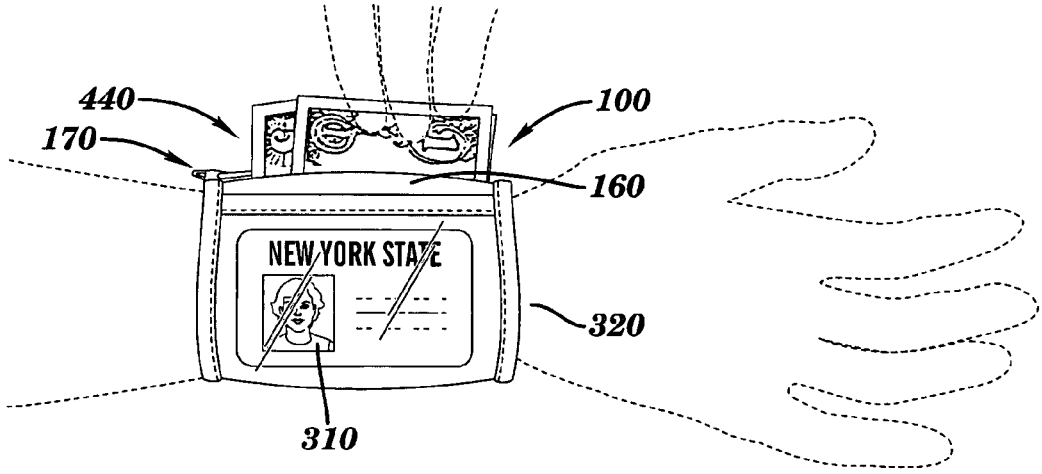
FIG. 4 depicts a perspective view of the wearable display wallet of FIG. 3 further showing access to a compartment, in accordance with the present invention.
Figure 5:
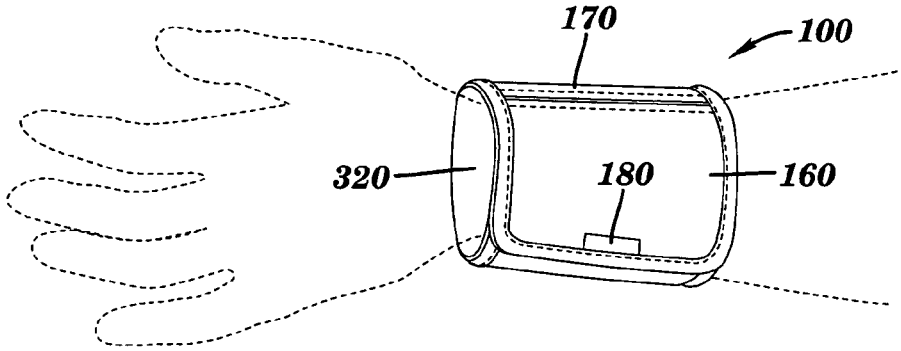
FIG. 5 depicts a perspective view of the wearable display wallet showing the opposite side of that shown in FIGS. 3 and 4, in accordance with the present invention.

FIG. 2 depicts a second side or surface of a wallet 100 for wearing on a person as outerwear, in accordance with the present invention. The second side or surface extends from a first edge 191 of the wallet 100 to a second edge 192 of the wallet 100. An embodiment of the present invention is the second side of the wallet 100 comprising: a panel 220 and a second hook 210 portion or section of a hook-and-loop closure device extending from the second edge 192. The panel 220 is made of pliable or non-pliable materials; stretchable or non-stretchable material; natural materials such as leather, cloth, fabric; and man-made materials such as nylon, vinyl, synthetic mesh, velvet, satin, sateen, neoprene, and polyester; and combinations thereof. The second hook portion 210 may be removably attachable to the loop 140 of the first portion or panel 141 such that the wearable display wallet 100 comprises a circumferentially enclosed band having an inner surface comprising one of the first surface and the second surface, and an outer surface comprising the other of the first surface and the second surface (as shown in FIGS. 4 and 5).

The panel 220 is generally rectangular in shape but may also include generally square shapes as well as combinations thereof. The hook 210 is for mating to a loop 140 of the panel 141. Mating of the hook 210 and the loop 140 closure device is for folding and closing the wallet 100. A first fold line 215 and a second fold line 216 indicate the approximate location of creases that naturally occur when the wallet 100 is folded into either a closed or display configuration. Fold lines 215 and 216 coincide with the edges of the panels 141, 151, and 161. Moreover, the fold lines 215 and 216 are substantially equidistant from the outer edges of the wallet 100.

Referring to FIG. 1 and FIG. 2, in an embodiment, wallet 100 comprises three segments which may be folded onto each other to releasably close and secure the wallet in either a closed or display configuration. The panels 141, 151, and 161 correspond to the three segments which may be folded onto each other.

Panel 141 comprises the loop 140 portion of a hook-and-loop closure device. The first portion or panel 141 may extend from the first edge 191. In an embodiment, the panel 141 is entirely covered by the loop 140. Alternatively, a fifth, a quarter, and a third of the panel 141, or any combination thereof, may by covered by the loop 140. Mating of the loop 140 with the hook 210 of the hook-and-loop closure device allows for releasably retaining wallet 100 in a closed configuration or in a display configuration as chosen by the user.

Panel 151 comprises: a display window 150 and a first hook 120 portion or section of a hook-and-loop closure device. The display window 150 is made of a clear or translucent material including but not limited to plastic, resin, or vinyl type materials. The material properties of the window 150 allows for displaying essential documents and items while also providing protection of the essential documents. The first hook portion or section 120 may be attached to the display window 150, as shown in the Figures. The loop section 140 may also extend a sufficient length to accept simultaneous attachment of both the first and second hook sections 120, 210. As shown in FIG. 1, the loop section 140 may extend from the first end 191 to at least one quarter of the entire length of the first surface or side.

The hook 120 of the panel 151 has a loop portion of a hook-and-loop closure device directly underneath. The loop may be an extension of the loop 141 or a separate loop portion. In an embodiment of the present invention, the aforementioned loop portion of a hook-and-loop closure device is an extension of the loop 141 and will be referred herein as loop 141.

A display compartment or second pocket exists between the panel 151 and the display window 150 for holding essential documents and items that may be viewed through the display window 150. The hook 120 and loop section 140 closure allows for inserting and removing as well as securing essential documents within the aforementioned pocket. In other words, the first hook section 120 and the loop section 141 may be removably attachable to allow for selectable access and enclosure of the display compartment. The first hook section 120 may extend only partially through the length of the loop 140 and the first portion or panel 141. To insert a document, a user needs only to pull the hook 120 away from the loop 141 allowing access to the pocket while depressing the hook 120 back onto the loop 141 with minimal pressures secures the document. To remove a document, the user pulls the hook 120 away from the loop 141, removes the document, and depresses the hook 120 back onto the loop 141.

In an alternative embodiment, the display compartment that exists between the panel 151 and the display window 150 may include a flexible display screen, such as, inter alia, a flat screen display or polytronic (i.e., polymer electronic) display.

The second portion or panel 161 extends from the second edge to a closure 170. A first compartment or pocket 160 also exists between the panel 151 and the panel 220, i.e. behind the panel 151, for holding essential documents and items. The compartment 160 extends the length of the panel 220 between the panel 220 and the panels 141, 151, and 161. The compartment can be accessed via the zipper 170 closure. The zipper 170 closure may be replaced by any suitable fastening device that allows for the insertion and removal of essential documents and items. Alternatively, a zipper also may be integrally installed along the top of the wallet 100 that traverses the length of the panels 141, 151, and 161. This zipper may subsequently be used to allow selectable access and the sealing of the compartment 160.

The periphery of the wallet 100 is protected and strengthened by a binder tape 130 which is sewn around the edge of the wallet 100. A product/manufacturer tab 180 is operatively added to the binder tape 130 for manufacturer identification.

Figure 3:
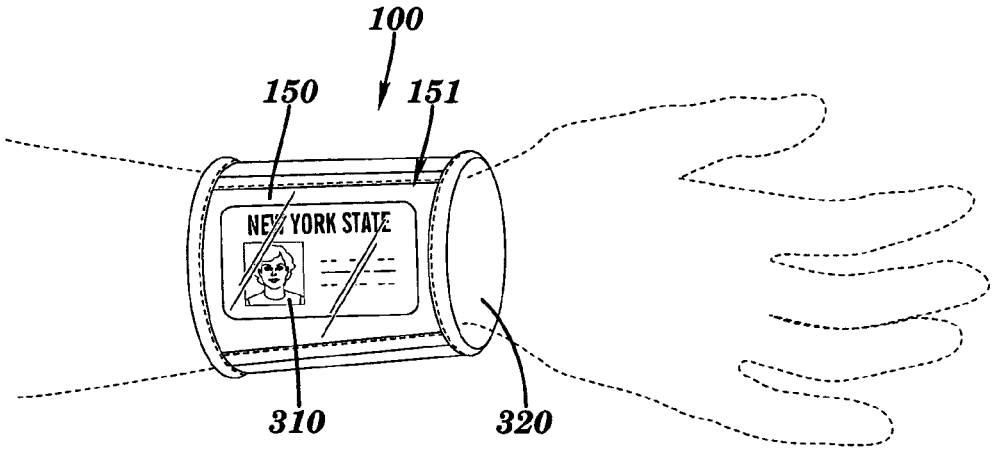
FIG. 3 depicts a perspective view of the wearable display wallet worn on a wrist in a display configuration, in accordance with the present invention.

FIG. 3 depicts a perspective view of the wearable display wallet 100 worn on a wrist 320 in a display configuration, in accordance with the present invention. In an embodiment, the panel 151 retains the user's driver's license 310 in the display compartment for ready display via the display window 150. Referring to FIG. 1, FIG. 2, and FIG. 3, the display configuration is obtained by mating the hook 210 of panel 220 with the loop 140 of panel 141 such that the display window 150 and the display compartment are on the exterior of the wallet 100.

FIG. 4 depicts a perspective view of the wearable display wallet 100 of FIG. 3 further showing access to the compartment 160, in accordance with the present invention. As shown in FIG. 4, the wallet 100 is worn on the wrist 320 in the display configuration. The compartment 160 is being accessed, via the zipper closure 170, to retrieve an essential item. In an embodiment of the present invention, the essential item is a currency 440 previously secured in the compartment 160.

FIG. 5 depicts a perspective view of the wearable display wallet 100 showing the opposite side of that shown in FIGS. 3 and 4, in accordance with the present invention. As shown in FIG. 5, the wallet 100 is worn on the wrist 320 with the zipper closure 170, the manufacturer label 180, and the panel 160 evident.

Figure 6:
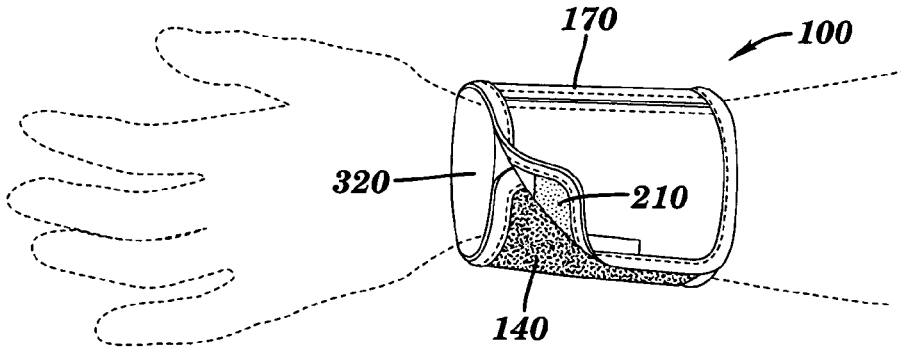
FIG. 6 depicts a perspective view of the wearable display wallet of FIG. 5, further showing the fastening device for attaching the wallet to a wrist, in accordance with the present invention.

FIG. 6 depicts a perspective view of the wearable display wallet of FIG. 5, further showing the fastening device for securing the wallet 100 to the wrist 320 of the user, in accordance with the present invention. Referring to FIG. 3, FIG. 4, FIG. 5 and FIG. 6, the mating of the hook 210 on panel 220 with the loop 140 of the panel 141 is illustrated. The hook 210-and-loop 141 fastening device of the wallet 100 is releasably securing the wallet 100 around the wrist 320 in the display configuration.

Figure 7:
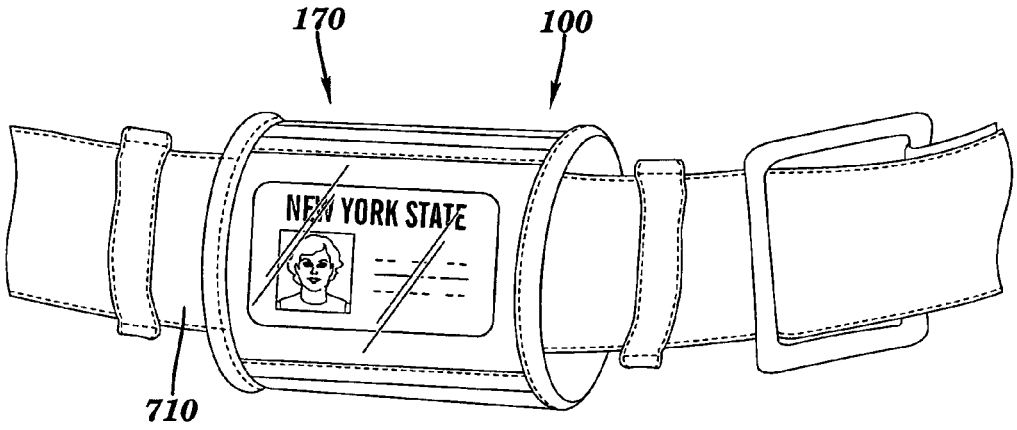
FIG. 7 depicts a perspective view of the wearable display wallet worn on a belt in a display configuration, in accordance with the present invention.

FIG. 7 depicts a perspective view of the wearable display wallet 100 worn on a belt 710 in a display configuration, in accordance with the present invention. Referring to FIG. 1, FIG. 2, FIG. 3, and FIG. 7, in an embodiment of the present invention, the essential document is a user driver's license 310 secured in the display compartment and visible via the display window 151. The zipper closure 170 is shown as reference. The wallet 100 is in the display configuration as shown by the display window 151 being on the exterior of the wallet 100. The display compartment and the compartment 160 are readily accessible in the display configuration via the zipper closure 170. The wallet 100 is releasably secured to the belt 710 via the mating of the hook 210 on panel 220 with the loop 140 of the panel 141. Alternatively, the wallet 100 may fastened, in the display configuration, to a necklace; other body extremities such as a forearm, upper arm, ankle, and the like; and other garments worn by the user.

Figure 8:
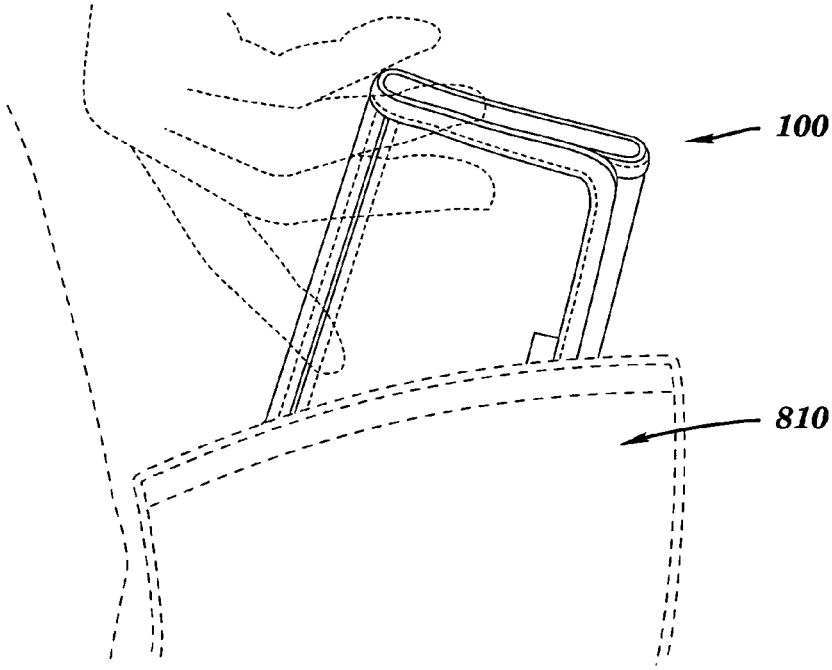
FIG. 8 depicts a perspective view of the wearable display wallet in a closed configuration, in accordance with the present invention.

FIG. 8 depicts a perspective view of the wearable display wallet 100 in a closed configuration, in accordance with the present invention. Referring to FIG. 1, FIG. 2, FIG. 3, and FIG. 8, the closed configuration is equivalent to the traditional manner in which conventional wallets are carried, such as in a garment pocket 810. The closed configuration is a reverse embodiment of the display configuration as shown in FIG. 3. The wallet 100 is simply folded along fold lines 215 and 216 to give the closed configuration having the display compartment on an interior of the wallet 100 and releasably secured via the mating of the hook 210 on panel 220 with the loop 140 of the panel 141.

Alternatively, the wallet 100 may be wrapped around a personal item such as, inter alia, a traditional wallet, a personal digital assistant (PDA), a cell phone, an address book, personal electronics such a MP3 player, a cassette player, a digital camera, and the like; and combinations thereof.

Referring to FIG. 1-FIG. 8, an embodiment of the present invention is the wallet 100 constructed of 400 denier nylon pack-cloth edged with bias cut nylon twill (approximately ½" in width) with reinforced nylon stitching. The wallet 100 may measure approximately 10¾" long by 4¼" wide and have rounded corners. In this configuration, the wallet 100 is termed as the large/extra large size.

Panel 220 (facing the wearer's arm in the display configuration) has a 1" strip of hook 210 fastening. Panel 141 (facing out in the display configuration) features a 2½" strip of loop 140 fastening along the panel 141. When the wallet 100 is worn in a display configuration, the hook 210 and the loop 140 fasten to secure the wallet 100 around the wearer's wrist, belt or wallet such that the display window 151 is on the exterior of the wallet 100, i.e., facing outward.

Panel 220 (facing the wearer's arm)—save the hook 210 fastening and twill edging—may be free of design. In the display configuration, the front of the wallet 100 includes the compartment 160 that is accessed through the zipper closure 170. The zipper 170 features a locking pull, measures approximately 3¾" wide and is located about 3½" from the end of panel 161. The zipper 170 lies opposite the 2½" strip of loop 140 fastening. The compartment 160 includes approximately 10" of interior storage space, spanning nearly the entire length of the wallet 100. The manufacturer tag 180 tag, about 1" wide, and extending approximately ¼" from underneath the binding 130, is sewn into the binding 130 opposite the zipper 170.

The wallet 100 features a clear plastic display window 150 measuring approximately 3½" by 3¾", and is bound on all four edges by the binding 130. The display window 150 has the ¾" strip of hook 120 fastening underneath it at one edge of the display window 150. The hook 120 fastening attaches to a 2½" patch of loop 141 that extends just underneath the display window 150. fastening to secure the compartment.

The foregoing description of the present invention has been presented for purposes of illustration and description. It is not intended to be exhaustive or to limit the invention to the precise form disclosed or to the materials in which the form may be embodied, and many modifications and variations are possible in light of the above teaching. Such modifications and variations that may be apparent to a person skilled in the art are intended to be included within the scope of this invention as defined by the accompanying claims.

What is claimed is:

1. A wearable data display comprising:

a first side of the wallet configured to display when facing outwards;

a display compartment positioned on said first side of the wallet, configured to allow viewing of an essential document, a first hook section attached to the display compartment for allowing selectable access and enclosure of the display compartment;

a compartment positioned on said first side, made of a concealing material, having a closure configured to hold and conceal essential items positioned adjacent said display compartment;

a loop section positioned on the first side of the wallet dimensioned to allow adjustment of diameter of the wallet when worn on the wrist;

a second side of the wallet, wherein the second side has an outside made of a concealing material; and a second hook section positioned on the second side of the wallet for releaseable attachment to the loop section on the first side of the wallet for creating a circular band, wherein the wallet may be configured to display by being worn upon the wrist exposing outwards the first side of the wallet or configured to conceal by being worn upon the wrist exposing outwards the second side of the wallet;

wherein the loon section extends for a sufficient length to accept simultaneous attachment of both the first and second hook section.

2. The wallet of claim 1, wherein the wallet is made of materials selected from the group consisting of leather, cloth, fabric nylon, vinyl, synthetic mesh, velvet, satin, sateen, neoprene, polyester, and combinations thereof.

3. The wallet of claim 1, wherein the wallet is configured to be releasably attachable.

4. The wallet of claim 3, wherein at least one compartment, made of concealing material, is configured for holding either an essential documents or essential items.

5. The wallet of claim 4, wherein the essential documents are selected from the group consisting of driver's licenses or identification cards.

6. The wallet of claim 4, wherein the essential items are currency.

7. A method of wearing a display wallet comprising:

providing a wearable display wallet, the wearable display wallet comprising:

a first side of the wallet configured to display when facing outwards;

a display compartment positioned on said first side of the wallet, configured to allow viewing of an essential document, a first hook section attached to the display compartment for allowing selectable access and enclosure of the display compartment;

a compartment positioned on said first side, made of a concealing material, having a closure configured to hold and conceal essential items positioned adjacent said display compartment;

a loop section positioned on the first side of the wallet dimensioned to allow adjustment of diameter of the wallet when worn on the wrist;

a second side of the wallet, wherein the second side has an outside made of a concealing material; and a second hook section positioned on the second side of the wallet for releaseable attachment to the loon section on the first side of the wallet for creating a circular band, wherein the wallet may be configured to display by being worn upon the wrist exposing outwards the first side of the wallet or configured to conceal by being worn upon the wrist exposing outwards the second side of the wallet;

wherein the loon section extends for a sufficient length to accept simultaneous attachment of both the first and second hook section;

releasably attaching the wallet to an extremity of a body in a display configuration, wherein the display configuration includes the display compartment on the exterior of the wallet by attaching the fastening device on the first panel to the second panel around the extremity;

detaching the wallet from the extremity of the body; and relesably attaching the wallet to the extremity in a closed configuration, wherein the closed configuration includes the display compartment on the interior of the wallet.

8. The method of claim 7, wherein the fastening device is a releasable hook-and-loop closure device.

9. The method of claim 7, wherein the wallet further contains at least one compartment.

10. The method of claim 9, wherein at least one compartment is configured for holding essential documents or essential items.

11. The method of claim 7, wherein the extremity of the body is a wrist.

12. A wearable display wallet comprising:

a first surface extending from a first edge to a second edge, the first surface comprising:

a first portion extending from the first edge and being made of at least one of a hook and loop fastener material;

a second portion extending from the second edge to a closure, the closure allowing selectable access and sealing of a first pocket, the second portion being made of a concealing material; and a third portion located between the first portion and the second portion, the third portion including a display window extending proximal from the closure toward the first end, the display panel made of a flexible and transparent screen, the third portion further including a first hook or loop fastener portion removably attachable with the first portion to create a second pocket such that first the first hook or loop fastener portion extends only partially through the first portion, the second pocket viewable through the display window;

and a second surface located opposite the first surface and extending from the first edge to the second edge, the second surface including a second hook or loop fastener portion extending from the second edge, the second hook or loop fastener portion removably attachable to the first portion such that the wearable display wallet comprises a circumferentially enclosed band having an inner surface comprising one of the first surface and the second surface, and an outer surface comprising the other of the first and the second surface.

13. The wearable display wallet of claim 12, wherein the second surface is made of a concealable material.

14. The wearable display wallet of claim 12, wherein the first pocket extends substantially from the first end to the second end.

15. The wearable display wallet of claim 12, wherein the first portion is made of a loop fastener material, and the first hook or loop fastener portion is made of a hook fastener material, and the second hook or loop fastener portion is made of a hook fastener material.

16. The wearable display wallet of claim 12, wherein the first portion extends from the first end to the second end a length that allows a circumference of the circumferentially enclosed band to be adjustable.

17. The wearable display wallet of claim 12, wherein the first portion extends from the first end at least one quarter of the entire length of the first surface.

* * * * *